US012636559B2

(12) United States Patent
Zhang

(10) Patent No.: US 12,636,559 B2
(45) Date of Patent: May 26, 2026

(54) PORTABLE BASKETBALL GOAL SYSTEM WITH REMOVABLE REBOUND ASSEMBLY

(71) Applicant: Suzhou Innovative Sports Goods Co., Ltd., Jiangsu Province (CN)

(72) Inventor: Rongliang Zhang, Kwun Tong (HK)

(73) Assignee: Suzhou Innovative Sports Goods Co., Ltd. (CN)

( * ) Notice: Subject to any disclaimer, the term of this patent is extended or adjusted under 35 U.S.C. 154(b) by 710 days.

(21) Appl. No.: 17/863,385

(22) Filed: Jul. 12, 2022

(65) Prior Publication Data

US 2023/0302340 A1 Sep. 28, 2023

(30) Foreign Application Priority Data

Mar. 24, 2022 (CN) ..... 202210303580.6

(51) Int. Cl.
*A63B 63/08* (2006.01)
*A63B 63/00* (2006.01)
*A63B 71/02* (2006.01)

(52) U.S. Cl.
CPC ..... *A63B 63/083* (2013.01); *A63B 71/023* (2013.01); *A63B 2063/001* (2013.01); *A63B 2071/026* (2013.01)

(58) Field of Classification Search
CPC ..... A63B 63/083; A63B 2071/026; A63B 2063/001; A63B 71/023
See application file for complete search history.

(56) References Cited

U.S. PATENT DOCUMENTS 2,838,308 A * 6/1958 Polite ..... A63B 63/083 473/488
3,368,814 A * 2/1968 Kolwicz ..... A63F 9/0204 273/342

(Continued)

FOREIGN PATENT DOCUMENTS

CN 101920098 A 11/2011
CN 206499845 U * 9/2017

(Continued)

OTHER PUBLICATIONS

CN206499845U (Year: 2017).*
CN 110314354 A (Year: 2019).*

*Primary Examiner* — Nicholas J. Weiss
*Assistant Examiner* — Amir A Klayman
(74) *Attorney, Agent, or Firm* — LaMorte & Associates P.C.

(57) ABSTRACT

A system that includes a portable basketball goal assembly and a rebound assembly that can be used together as a single piece of equipment or split and used as separate pieces of equipment. The rebound assembly has a rebound frame that is supported on a base frame. The angle of inclination of the rebound frame relative to the base frame can be selectively adjusted. The rebound frame defines a first central opening. The base frame defines a second central opening. A flexible rebound surface spans the first central opening. The rebound assembly selectively connects to, and detaches from, the portable basketball goal assembly. When the rebound assembly is attached to the portable goal assembly, the rebound surface redirects basketballs that fall through the net. When the rebound assembly is detached from the portable basketball goal assembly, the rebound assembly is free standing.

10 Claims, 7 Drawing Sheets

(56) References Cited

U.S. PATENT DOCUMENTS 3,502,330 A 3/1970 Cheftel
4,068,846 A * 1/1978 Forrest ..... A63B 63/00 473/439
4,553,751 A * 11/1985 Ketchum ..... A63B 69/0024 273/395
4,615,528 A * 10/1986 York ..... A63B 63/00 473/194
4,759,545 A * 7/1988 Grable ..... A63B 63/083 473/481
4,915,380 A * 4/1990 Ackerman ..... A63B 63/083 473/435
5,039,109 A * 8/1991 Mahoney ..... A63B 69/0097 248/647
5,273,276 A * 12/1993 Warren ..... A63B 63/083 473/435
5,300,920 A * 4/1994 Caselli ..... A63B 63/083 473/480
5,415,393 A * 5/1995 Fitzsimmons ..... A63B 71/023 248/528
5,558,338 A * 9/1996 Taub ..... A63B 69/0097 473/416
5,613,922 A * 3/1997 Hsiang ..... A63B 69/0097 482/28
5,772,537 A * 6/1998 Anderson ..... A63B 69/0097 273/396
5,833,234 A 11/1998 Vavala et al.
5,902,197 A * 5/1999 Davis ..... A63B 63/083 473/479
5,967,911 A * 10/1999 McAvoy ..... A63B 69/0071 273/342
D462,733 S 9/2002 Smith, IV
6,537,161 B2 * 3/2003 Manix ..... A63B 24/0021 473/433
6,595,877 B2 * 7/2003 Pearson ..... A63B 69/0071 473/433
6,733,403 B2 * 5/2004 Courtright ..... A63B 69/0071 473/433
8,043,172 B2 * 10/2011 Campanaro ..... A63B 69/0097 273/395
8,496,546 B2 * 7/2013 Bulloch ..... A63B 69/0097 273/395
8,876,637 B2 * 11/2014 Atkins ..... A63B 69/0071 473/433
9,155,952 B2 * 10/2015 Yamanashi ..... A63B 69/0097
9,808,697 B2 * 11/2017 Dorsett ..... A63B 69/0097
D805,591 S * 12/2017 Miller ..... D21/698
10,166,453 B1 * 1/2019 Dickerson ..... A63B 63/00
10,709,947 B2 * 7/2020 Kapsalis ..... A63B 47/02
11,819,747 B2 * 11/2023 Fedon ..... A63B 71/023
2006/0105852 A1 5/2006 Curry
2007/0026976 A1 2/2007 Nye et al.
2007/0042843 A1 * 2/2007 Nye ..... A63B 63/083 473/481
2016/0023074 A1 * 1/2016 Girman ..... A63B 67/06 273/336
2016/0199718 A1 * 7/2016 Holland ..... A63B 69/0097 473/435
2017/0189773 A1 * 7/2017 Cho ..... A63B 63/00
2022/0347537 A1 * 11/2022 Hall ..... A63B 63/083

FOREIGN PATENT DOCUMENTS

CN 207605330 U 7/2018
CN 110314354 A * 10/2019 ..... A63B 63/083
CN 215822230 U 2/2022
WO WO-2009021261 A1 * 2/2009 ..... A63B 63/083

* cited by examiner

PORTABLE BASKETBALL GOAL SYSTEM WITH REMOVABLE REBOUND ASSEMBLY

BACKGROUND OF THE INVENTION

1. Field of the Invention

In general, the present invention relates to rebound assemblies that are used to rebound a ball in a particular direction after a ball impacts the rebound assembly. More particularly, the present invention relates to rebound assemblies that are specifically designed to rebound basketballs and are used in conjunction with portable basketball goals.

2. Prior Art Description

Many people own portable basketball goal assemblies. These types of assemblies hold a basketball rim and a backboard above a portable base. The base is typically filled with water, sand, or gel to stabilize the basketball goal assembly and ensure that the assembly does not fall over during play. Since the base is required to hold a significant volume of water, sand or gel, the bases of portable basketball goal assemblies tend to be large and bulky. Furthermore, the base is often located in, or near, the drop zone of the basketball. That is, a basketball that passes through the rim may impact a section of the base or impact a support strut that extends from the base. When the basketball strikes the base or a support strut, the basketball can rebound in a random direction. This is highly inconvenient to the person who has to chase and retrieve the basketball.

In an attempt to limit the number of uncontrolled rebounds, many portable basketball goal assemblies utilize a rebound panel. The rebound panel is a flat inclined panel that extends from the base to the vertical pole under the rim. When a ball passes through the rim and falls toward the base, the ball will likely strike the inclined rebound panel. Due to the inclination of the rebound panel, the basketball is most likely to be rebounded back onto the court of play. Such prior art rebound panels are exemplified by U.S. Pat. No. 5,415,393 to Fitzsimmons.

On problem associated with such a rebound panel is that the rebound panel is bolted in place. Accordingly, the rebound panel cannot be adjusted in any manner. Additionally, the rebound panel cannot be removed from the portable basketball goal and used as a separate piece of practice equipment.

In addition to shooting baskets, basketball players often practice passing and receiving passes. If a player is practicing alone, a player must utilize a separate rebound assembly to practice passing and receiving back the rebound. Such auxiliary rebound assemblies are typically small trampoline pads that are mounted to adjustable support bases. Such prior art rebound assemblies are exemplified by U.S. Pat. No. 5,833,234 to Vavala and U.S. Patent Application Publication No. 2006/0105852 to Curry.

Prior art trampoline-style rebound assemblies also have drawbacks. Such rebound assemblies are either mounted to the ground or are very large and heavy. This is required to prevent the rebound assembly from moving when impacted with a thrown basketball. Accordingly, prior art rebound assemblies are difficult to move from place to place during practice. Furthermore, after practice, the rebound assembly is difficult to remove and store.

A need therefore exists for a rebound assembly that can be used as part of a portable basketball goal or can be used separately as an independent piece of practice equipment. A need also exists for a rebound device that is sturdy, yet is easy to position and store when not in use. These needs are met by the present invention as described and claimed below.

SUMMARY OF THE INVENTION

The present invention is a system that includes a portable basketball goal assembly and a rebound assembly that can be used together as a single piece of equipment or split and used as separate pieces of equipment. The portable basketball goal assembly has a base, a pole, a backboard and a rim. The rebound assembly has a rebound frame that is supported on a base frame. The angle of inclination of the rebound frame relative to the base frame can be selectively adjusted. The rebound frame defines a first central opening. The base frame defines a second central opening. A flexible rebound surface spans the first central opening. The rebound assembly selectively connects to, and detaches from, the portable basketball goal assembly.

When the rebound assembly is attached to the portable goal assembly, the rebound surface can be used to redirect basketballs that fall through the net. The angle of the rebound can be selectively adjusted. When the rebound assembly is detached from the portable basketball goal assembly, the rebound assembly is free standing. The rebound surface can then be adjusted to many angles of inclination so the rebound direction suits the needs of a player.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention rebound assembly can be embodied in many ways, only one exemplary embodiment is illustrated. The exemplary embodiment is being shown for the purposes of explanation and description. The exemplary embodiment is selected in order to set forth one of the best modes contemplated for the invention. The illustrated embodiment, however, is merely exemplary and should not be considered a limitation when interpreting the scope of the appended claims.

Figure 1:
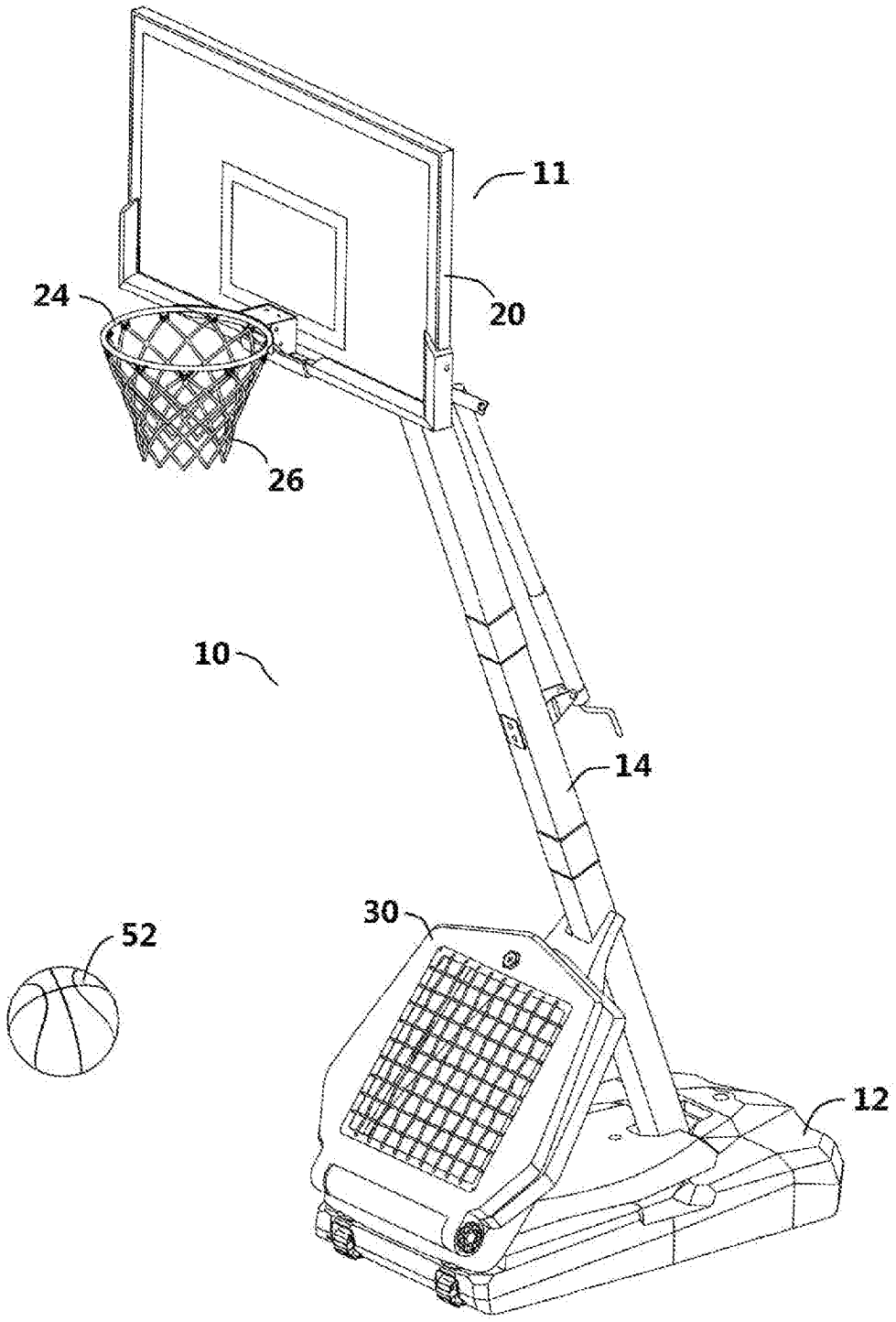
FIG. 1 is an exemplary embodiment of a system that includes a portable basketball goal assembly and a rebound assembly.
Figure 2:
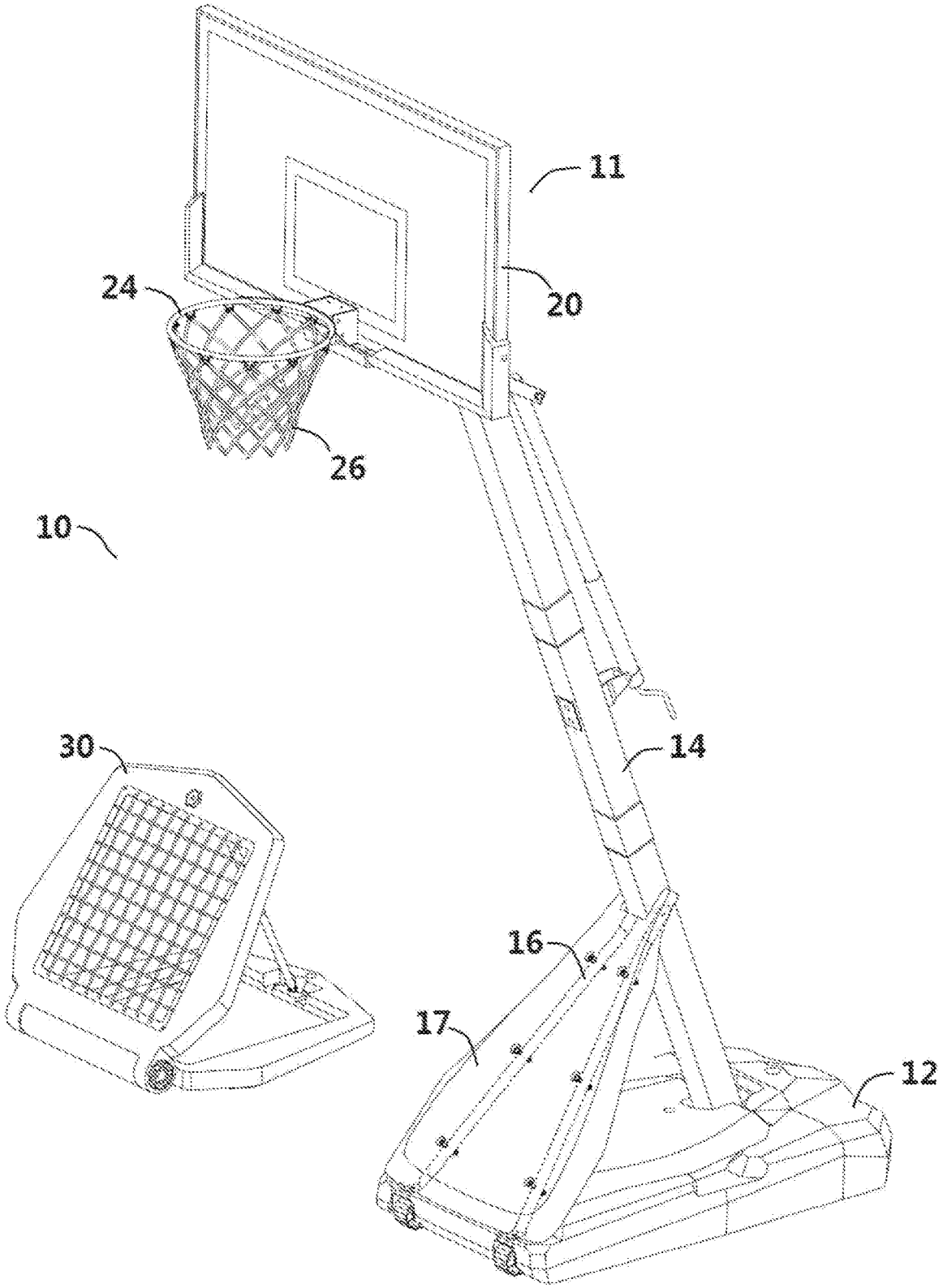
FIG. 2 shows the exemplary embodiment of FIG. 1 with the rebound assembly separated from the portable basketball goal assembly.

Referring to FIG. 1 and FIG. 2, a system 10 is shown that includes a portable basketball goal assembly 11 with a detachable rebound assembly 30. It will be understood that there are many portable basketball goal assemblies 11 that are commercially available. Most all such prior art portable basketball goal assemblies 11 can be adapted for use with, or as part of, the present invention system 10. The portable basketball goal assembly 11 shown is intended to represent any and all prior art designs.

The portable basketball goal assembly 11 selected for illustration has a base 12. The base 12 can be blow-molded and is capable of holding a significant weight of water, sand or gel. A pole 14 extends from the base 12. The pole 14 is stabilized by an angled support 16 that extends from the base 12 to an elevated position on the pole 14 at an inclined angle. In the shown embodiment, a panel 17 is used as the angled support 16. It will be understood that support struts can be used in place of the panel 17 to stabilize the pole 14.

The pole 14 supports a backboard 20. The backboard 20 can be stationary or may be selectively adjusted in height using known adjustment mechanisms. A hoop 24 and a net 26 are affixed to the backboard 20.

Figure 3:
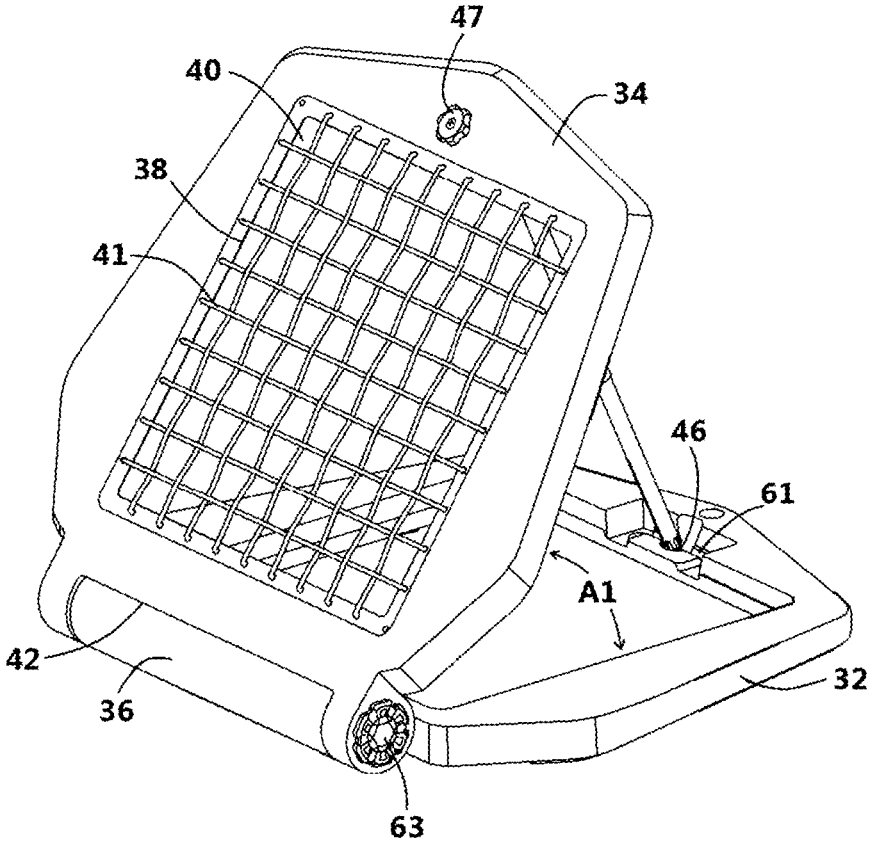
FIG. 3 shows a front perspective view of the rebound assembly.
Figure 4:
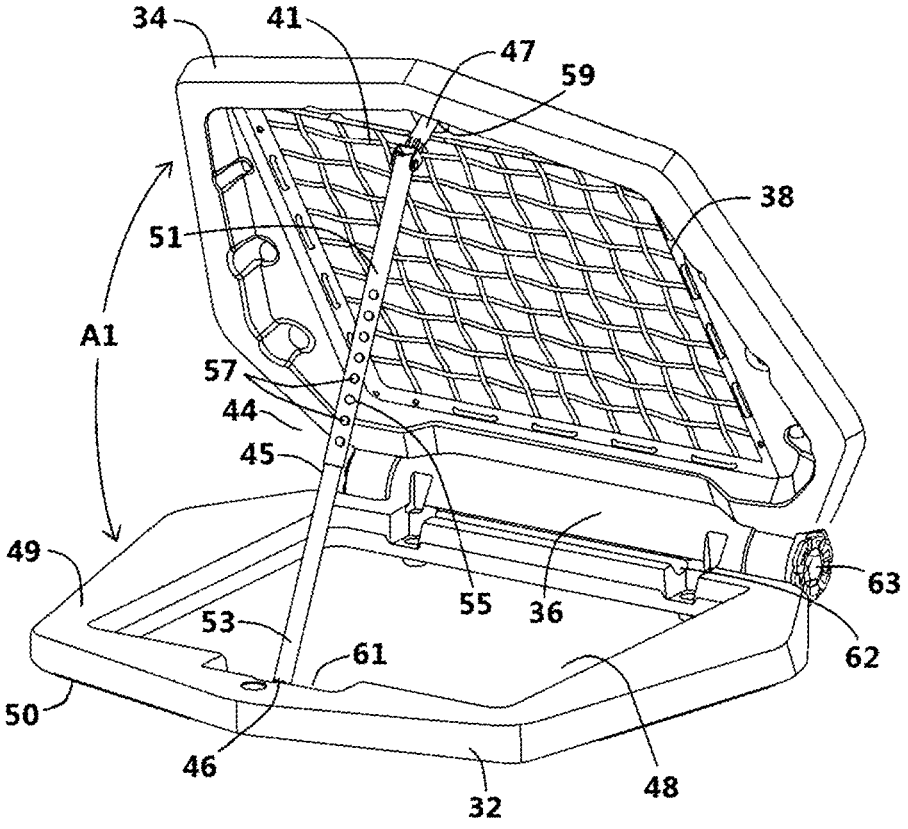
FIG. 4 shows a rear perspective view of the rebound assembly.

The rebound assembly 30 can be used independently or can be integrated with the portable basketball goal assembly 11. Referring to FIG. 3 and FIG. 4, it can be seen that the rebound assembly 30 includes a base frame 32 and a rebound frame 34. The base frame 32 and the rebound frame 34 are connected at a shared hinge joint 36. The rebound frame 34 defines a large central opening 38. In the shown embodiment, the central opening 38 is square in shape. However, it should be understood that other shapes, such as rectangular openings, round openings and elliptical openings can also be used. A rebound surface 40 is suspended across the central opening 38. In the shown embodiment, the rebound surface 40 is a segment of elastic netting 41. However, it will be understood that a solid sheet of elastic material can be used in place of the netting 41. Likewise, a sheet of non-elastic material can be used, provided the material is attached to the rebound frame 34 with springs, in the same manner as a trampoline. Regardless of the construction technique used, the rebound surface 40 is capable of rebounding an impacting basketball at a rebound velocity that is at least forty percent of the impact velocity.

The rebound frame 34 has a bottom edge 42. The bottom edge 42 is connected to the base frame 32 at the hinge joint 36. Accordingly, the base frame 32 and the rebound frame 34 meet at a variable angle of inclination A1 as the base frame 32 and/or the rebound frame 34 rotate about the hinge joint 36. The hinge joint 36 enables the rebound frame 34 to be folded flush against the base frame 32. When rotated out of this flush configuration, the hinge joint 36 enables the angle of inclination A1 between the base frame 32 and the rebound frame 34 to be selectively adjusted.

A locking mechanism 44 is provided that can set a fixed angle of inclination A1 between the rebound frame 34 and the base frame 32. The locking mechanism 44 can be any mechanism that locks the hinge joint 36 at a selected angle of inclination. In the shown embodiment, the locking mechanism 44 is a telescoping prop bar 45. One end of the telescoping prop bar 45 is connected to second fixed part 46, in order to adjust the distance between the first fixed part 47 and the second fixed part 46.

The prop bar 45 has a first section 51 and a second section 53 that telescope. A detent pin 55 is disposed on the second section 53. The detent pin 55 engages a series of openings 57 that are formed on the first section 51. In this manner, a person can manually set the length of the prop bar 45. The prop bar 45 spans between the rebound frame 34 and the base frame 32 to maintain a selected angle of inclination A1. In the shown embodiment, the prop bar 45 is attached to the underside of the rebound frame 34 at a pivot joint 59. However, attaching the prop bar 45 to the base frame 32 would work equally as well. It does not matter if the first end 49 or the second end 49 of the prop bar 45 hosts the pivot joint 59. The end of the prop bar 45 opposite the pivot joint 59 extends into a relief 61. The relief 61 retains the prop bar 45 and prevents the prop bar 45 from being inadvertently knocked out of place. However, the prop bar 45 can be manually lifted out of the relief 61, wherein the prop bar 45 can be folded flat between the rebound frame 34 and the base frame 32.

The base frame 32 defines a central opening 48. The central opening 38 defined by the base frame 32 is preferably the same size or larger than the central opening 48 defined by the rebound frame 34. Accordingly, when the rebound frame 34 is rotated flush against the base frame 32, the base frame 32 does not block any of the central opening 38 of the rebound frame 34. In this manner, the rebound surface 40 is free to deform into the central opening 48 of the base frame 32 without contact interference with the base frame 32.

The base frame 32 itself is weighted. The base frame 32 can be made of heavy material. However, it is preferred that the base frame 32 have a hollow blow-molded construction. In this manner, the base frame 32 can be filled with ballast, such as sand, water or gel to weight the base frame 32. Likewise, the ballast can be removed to make the rebound assembly 30 easier to move and store when not in use. The base frame 32 has a top surface 49 and a bottom surface 50. When the rebound frame 34 is rotated against the base frame 32, the rebound frame 34 contacts and abuts the top surface 49 of the base frame 32.

Figure 5:
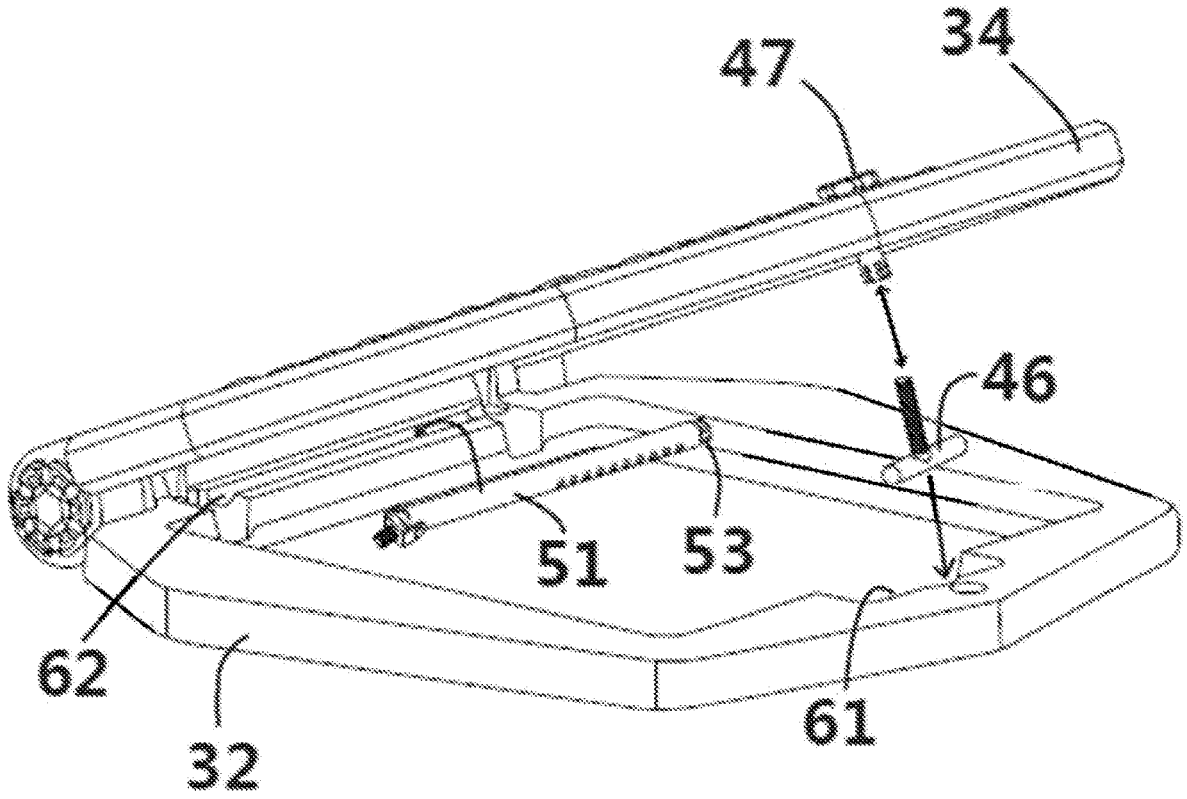
FIG. 5 shows a reverse rear perspective view of the rebound assembly.

Referring to FIG. 4 and FIG. 5 in conjunction with FIG. 2 and FIG. 3, it will be understood that the rebound assembly 30 can be separated from the portable basketball goal assembly 10. The bottom surface 50 of the base frame 32 is set on the ground. The weight of the base frame 32 inhibits the base frame 32 from moving. The locking mechanism 44 is set to establish a preferred angle of inclination A1. The locking mechanism 44 is then locked to maintain the set angle of inclination A1. A person can then pass a basketball 52 against the rebound surface 40 in the central opening 38 of the rebound frame 34. The basketball 52 will rebound off the rebound surface 40 at a complimentary angle to the angle of impact.

The angle of inclination between the rebound frame 34 and the base frame 32 is large, so the telescoping prop bar 45 is required to maintain the distance between the first fixed part 47 and the second fixed part 46 in the shown embodiment. To set the angle of inclination, use the detent pin 55 to engage with one of openings 57 on the first section 51, controlling the relative position of first section 51 and the second section 53.

Figure 6:
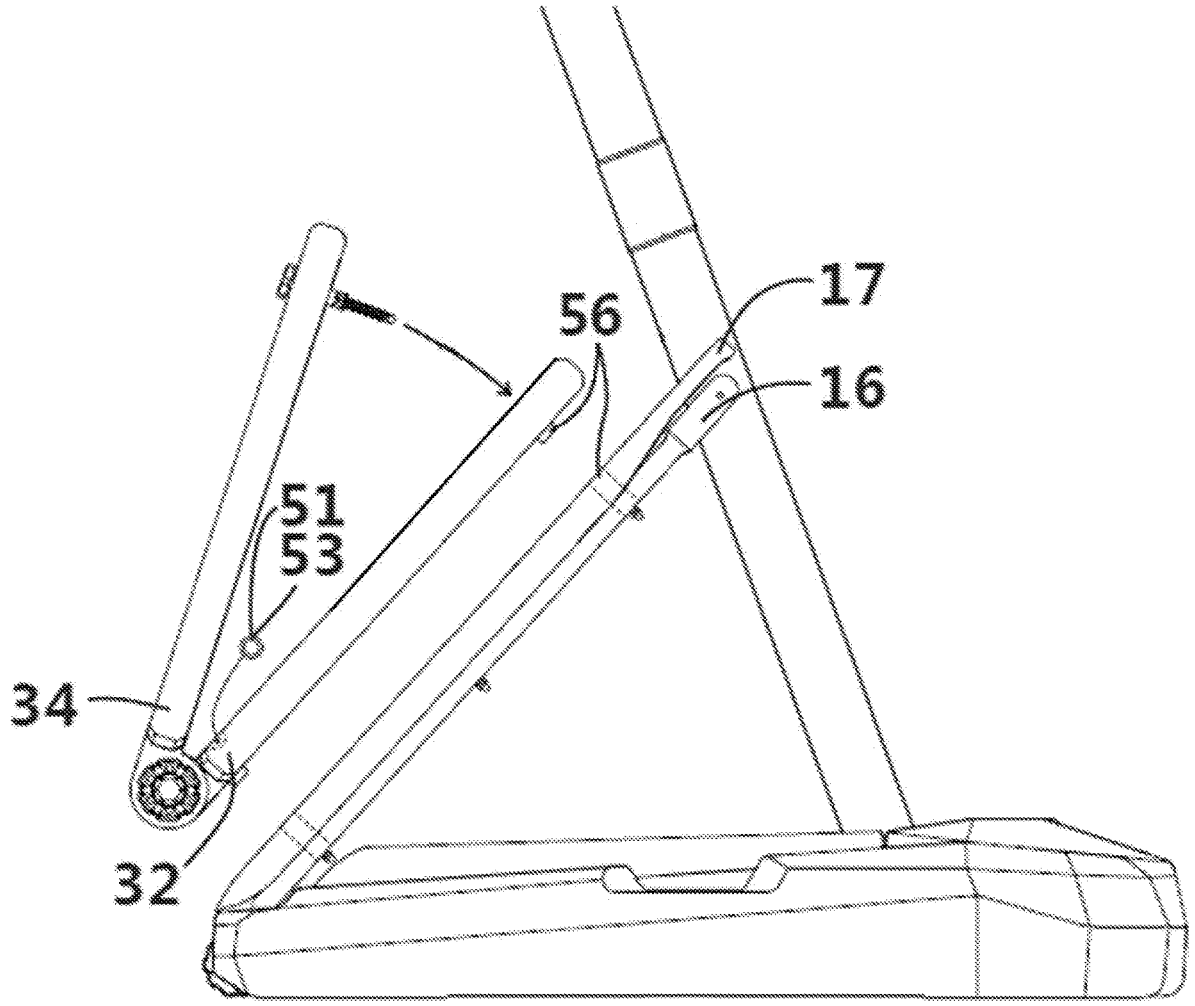
FIG. 6 shows a side view of the rebound assembly and portable basketball goal assembly to show connection and positioning details.
Figure 7:
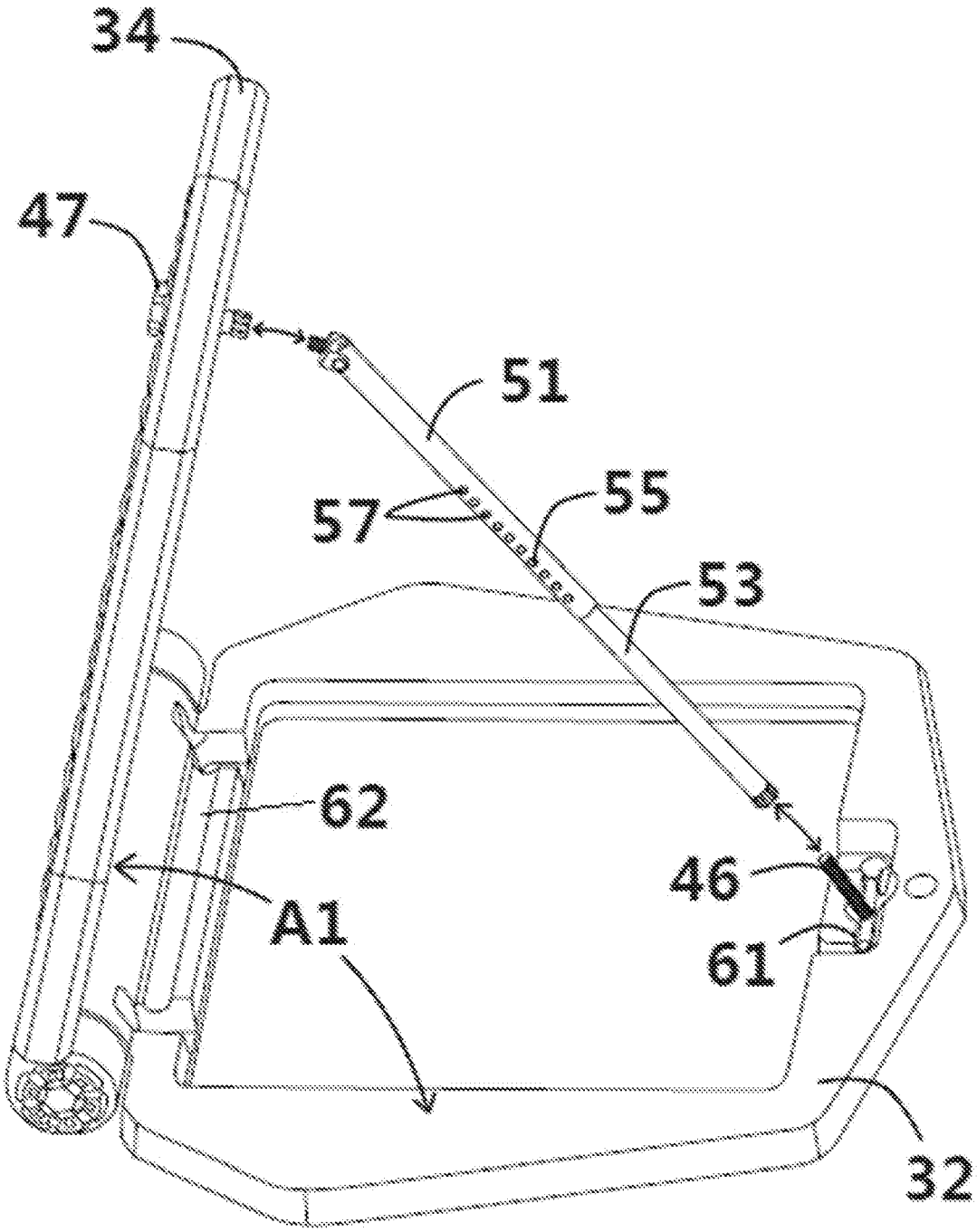
FIG. 7 shows a top perspective view of the rebound assembly.

Referring to FIG. 6 and FIG. 7 in conjunction with FIG. 5 and FIG. 1, it will be understood that the rebound assembly 30 can also be selectively attached to the portable basketball goal assembly 10. To attach the rebound assembly 30 to the portable basketball goal assembly 10, the rebound frame 34 is rotated about the hinge joint 36 until the rebound frame 34 lay flush against the top surface 49 of the base frame 32. The bottom surface 50 of the base frame 32 is then mounted against the angled support 16 that extends from the base 12 to the pole 14. In the shown embodiment, the angled support 16 is a panel 17. In other models of portable basketball goals, the angled support 16 could be a set of support struts. Regardless of the type of rebound support, the bottom surface 50 of the base frame 32 of the rebound assembly 30 is set flush against the angled support 16. The rebound assembly 30 is then mechanically attached to the angled support 16. The attachment can be accomplished using any detachable connection system 55, such as latches, hook and hole connectors, or pin and hole connectors. Once the base frame 32 of the rebound assembly 30 is attached to the angled support 16, the rebound assembly 30 is anchored to the portable basketball goal assembly 10. The locking mechanism 44 is used to set a preferred angle of inclination A1. A person can then toss the basketball 52 against the rebound surface 40 in the center of the rebound frame 34. The basketball 52 will rebound off the rebound surface 40 at a complimentary angle to the angle of impact.

In the shown embodiment, the angle of inclination A1 between the rebound frame 34 and the base frame 32 is small or there is no angle of inclination, because there exists certain angle of inclination on the angled support 16 or the panel 17, at which point the telescoping prop bar 45 can be placed in the slot 62 between the rebound frame 34 and the base frame 32, while adjust the angle of inclination between the rebound frame 34 and the base frame 32 directly by adjusting the distance between the first fixed part 47 and the second fixed part 46. For example, when the first fixed part 47 is a fixed nut structure, and the second fixed part 46 is a movable screw structure, the angle of inclination between the rebound frame 34 and the base frame 32 can be set by controlling the connecting depth of the screw structure in nut structure.

The present invention of rebound assemblies can be used independently or set in the corresponding portable basketball system, which is convenient for storage and movement when used alone, and can be compatible with the portable basketball system assemblies when used together. The rebound assemblies has different angle adjustment modes based on different use modes, corresponding to small angle adjustment and large angle adjustment respectively, which can meet the needs of users for angle adjustment in different scenarios and effectively solve the technical problems mentioned in the background technology.

It will be understood that the embodiment of the present invention that is illustrated and described is merely exemplary and that a person skilled in the art can make many variations to that embodiment. For instance, the size and shape of the rebound frame can be varied. All such embodiments are intended to be included within the scope of the present invention as defined by the claims.

What is claimed is:

1. A system comprising:

a portable basketball goal assembly having a pole base, a pole, and at least one angled support, wherein said at least one angled support extends from said pole base to an elevated position on said pole at an inclined angle;

a rebound assembly having a rebound frame that defines a first central opening, a flexible rebound surface that spans said first central opening, and a base frame that defines a second central opening, wherein said base frame of said rebound assembly selectively connects to, and detached from, said at least one angled support of said portable basketball goal assembly and wherein said second central opening of said rebound frame is as least as large as said first central opening spanned by said flexible rebound surface;

wherein said base frame and said rebound frame are interconnected at a joint connection that enables said rebound assembly to be manipulated between a flush configuration, where said rebound frame is folded flush against said base frame, and an angled configuration, where said rebound frame is oriented at a selected angle of inclination relative to said base frame; and wherein when in said flush configuration said base frame does not block any of said first central opening of said rebound frame.

2. The system according to claim 1, further including a locking mechanism for locking said rebound frame and said base frame at said selected angle of inclination.

3. The system according to claim 1, wherein said base frame is hollow and fillable with a ballast material selected from a group consisting of water, sand and gel.

4. The system according to claim 2, wherein said base frame can support said rebound assembly on a surface when separated from said portable basketball goal assembly, wherein said rebound frame extends upwardly from said base frame at said selected angle of inclination.

5. The system according to claim 1, wherein said first central opening aligns with said second central opening when said rebound frame rests flush atop said base frame.

6. A portable basketball goal system, comprising:

a pole base;

a pole;

at least one angled support that extends from said pole base to an elevated position on the pole at an inclined angle;

a backboard and rim that are elevated by said pole;

a rebound frame that defines a first central opening, wherein a flexible rebound surface spans said first central opening, base frame that defines a second central opening that is at least as large as said first central opening spanned by said flexible rebound surface, wherein said base frame is joined to said rebound frame with a joint connection that enables said rebound frame to rotate relative to base frame between a flush configuration where said rebound frame is folded flush against said base frame and an angled configuration where said rebound frame is oriented at a selected angle of inclination relative to said base frame;

wherein said base frame is mounted to said at least one angled support so that said rebound frame is disposed between said pole base and said pole and wherein said base frame does not block any of said first central opening of said rebound frame when in said flush configuration.

7. The system according to claim 6, wherein said rebound frame has a bottom edge, wherein said base frame is connected to said bottom edge of said rebound frame at said joint connection.

8. The system according to claim 7, wherein said base frame is attached to said at least one angled support with detachable fasteners.

9. The system according to claim 7, further including a locking mechanism for manually setting said rebound frame and said base frame at said angle of inclination.

10. The system according to claim 7, wherein said second central opening aligns with said first central opening of said rebound frame when in said flush configuration.

* * * * *